US006924692B2

(12) United States Patent
Fulton et al.

(10) Patent No.: US 6,924,692 B2
(45) Date of Patent: Aug. 2, 2005

(54) VOLTAGE REFERENCE GENERATOR

(75) Inventors: Robert Fulton, Folsom, CA (US); Andrew Volk, Granite Bay, CA (US); Chinnugounder Senthilkumar, Folsom, CA (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 10/609,513

(22) Filed: Jun. 30, 2003

(65) Prior Publication Data

US 2004/0263240 A1 Dec. 30, 2004

(51) Int. Cl.[7] ..... G05F 1/10; G05F 3/02
(52) U.S. Cl. ..... 327/541; 327/543; 327/327
(58) Field of Search ..... 327/538, 540–541, 327/543, 313, 321, 327

(56) References Cited

U.S. PATENT DOCUMENTS 4,585,955 A * 4/1986 Uchida ..... 327/541
5,097,303 A * 3/1992 Taguchi ..... 365/149
5,973,548 A * 10/1999 Ukita et al. ..... 327/540
6,232,805 B1 * 5/2001 Brandt ..... 327/108

* cited by examiner

*Primary Examiner*—Quan Tra
(74) *Attorney, Agent, or Firm*—Blakely, Sokoloff, Taylor & Zafman LLP

(57) ABSTRACT

According to an embodiment of the invention, a method and apparatus for dynamic reference voltage adjustment are described. According to one embodiment, a reference circuit comprises a reference node to provide a reference voltage; a first transistor device to receive a first configuration signal at a gate terminal, a current to flow through the first transistor device when the first configuration signal is a first value; and a second transistor device to receive a first voltage potential at a gate terminal, the current to flow through the second transistor device and the reference voltage to be increased by the first voltage potential when the configuration signal is a second value.

6 Claims, 5 Drawing Sheets

VOLTAGE REFERENCE GENERATOR

FIELD

An embodiment of the invention relates to electronic circuits in general, and more specifically to a voltage reference generator.

BACKGROUND

In certain electronic circuits, a voltage reference generator is used in the production of a voltage. In one example, a DC-to-DC voltage converter will generally include a reference load that is utilized in the generation of a reference voltage. In circuits in which power consumption is critical, the design of a reference load can have a significant impact on system performance. The reference load may be utilized to adjust the reference voltage as needed, which will affect how well the reference voltage potential can be maintained and adjusted. In addition, the reference load itself will consume a certain amount of power, which adds to the total power consumption of the system.

In one example, when a PC (personal computer) system is powered down, a RTC (real time clock) circuit may derive power from another power source, such as a self-contained source in the PC. A 3.0-volt coin cell lithium battery is generally used because such batteries are widely available and very inexpensive. In certain systems, another power source, such as a charged capacitor, may provide the power for the RTC circuit when the system is powered down. A PC system may be turned off for long periods of time, possibly for years, depending upon usage and the length of time a system may stay in storage. Therefore, an RTC circuit may potentially need to derive power from a coin cell battery or other such power source for a period of years to maintain system time.

As computer processes move towards lower voltages in order to reduce power consumption and to increase speed in digital sections, the voltage of a coin cell battery may need to be stepped down to a lower voltage, such as a voltage range of less than 2 volts, depending upon the process voltage. A system may include a DC-to-DC converter using a reference load to generate a reference voltage.

FIG. 1 illustrates one example of a conventional reference load incorporated in a DC-to-DC voltage generator. A voltage supply 105, such as a coin battery, provides a voltage to the circuit. The voltage supply is connected to the source of output transistor 135. The converter circuit includes diode-connected transistors $Q_2$ 110 and $Q_3$ 115, which provide voltage drops and step down the voltage to the gate of output device 135. A reference load is provided, shown in FIG. 1 as comprising diode-connected transistors $Q_4$ 120 and $Q_5$ 125. Connected between $Q_4$ 120 and $Q_5$ 125 is transistor device $Q_1$ 130. A current through $Q_1$ 130 to adjust the reference load is provided by a clamping control circuit 160, which is controlled by a signal 165. The output voltage 140 from the circuit is supplied to certain devices, shown as an RTC oscillator 145 and RTC logic 150 utilized in maintenance of system time.

BRIEF DESCRIPTION OF THE DRAWINGS

The invention may be best understood by referring to the following description and accompanying drawings that are used to illustrate embodiments of the invention. In the drawings.

DETAILED DESCRIPTION

Figure 1:
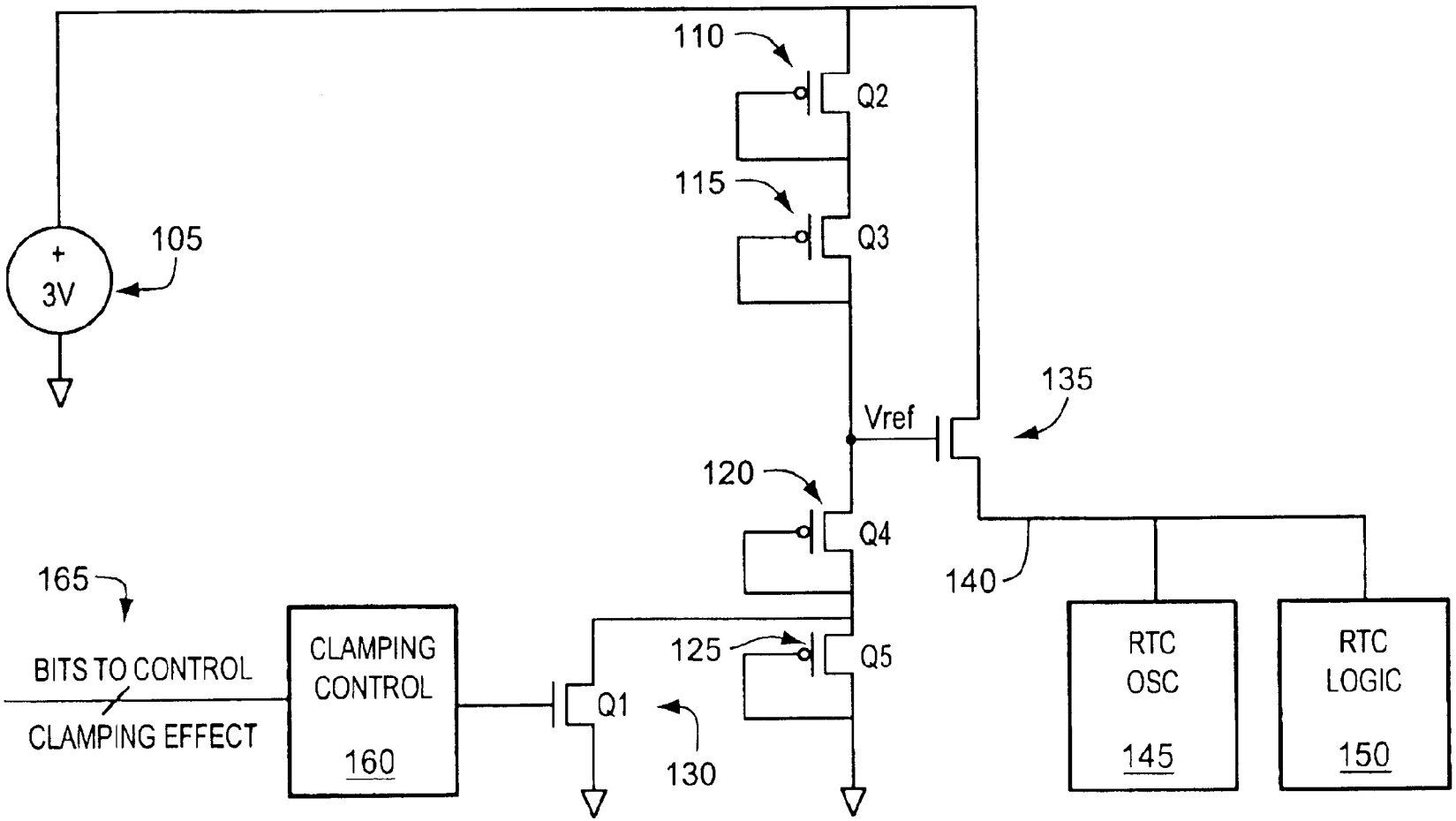
FIG. 1 PRIOR ART
FIG. 1 is an illustration of a conventional reference load for a circuit.

A method and apparatus are described for a voltage reference generator.

Under an embodiment of the invention, a voltage reference generator is provided for an electronic circuit. The voltage reference generator may be utilized in any device or circuit that produces a voltage reference level. According to an embodiment of the invention, the voltage reference generator allows for dynamic adjustment of the voltage reference value as needed by modifying current flow through multiple different devices. According to an embodiment of the invention, a voltage reference generator provides modification of a reference voltage by a known amount without unnecessary consumption of power.

In one embodiment of the invention, a voltage reference generator is a circuit utilized in a DC-to-DC voltage converter. In such embodiment, the voltage reference is provided to establish the output voltage of the converter. However, embodiments of the invention may be implemented in any environment in which a reference voltage is modified. An embodiment of the invention can be utilized in circuits that require adjustment of voltage levels in a post-silicon (after fabrication) stage.

An embodiment of the invention provides for dynamic modification of reference levels. The dynamic modification may allow for changes to reference levels to keep the output voltage at the minimum required level, thereby resulting in power savings. The dynamic modification of voltage levels may be used in a DC-to-DC converter to maintain appropriate output levels. In one example, a computer system contains a power source, such as a battery or charged capacitor, to power an RTC circuit when system power is turned off. A DC-to-DC converter may be utilized to provide the needed voltage level to the RTC circuit. An embodiment of the invention may be implemented in the DC-to-DC converter, thereby allowing for dynamic adjustment of the reference voltage level without excessive power consumption to extend the operational lifespan of the power source. In this example, extension of the operational lifespan of the power source allows maintenance of system time for a longer period of time without replacing or charging the power source.

An embodiment of the invention may be utilized to provide a voltage reference in an environment in which a guard-banded voltage range requires precise voltage adjustment in a configuration that consumes low power. Embodiments of the invention may be implemented in integrated circuits or other microelectronic devices.

According to an embodiment of the invention, a reference source can lower output voltages supplied to a circuit when necessary to conserve power and can raise voltages to higher levels that provide better or more consistent performance when more power is available for the circuit can be used. In some applications, the logic being powered by a DC-to-DC converter can have a low power state (sleep state) and a high power state (active state). According to an embodiment of the invention, logic may be powered by a battery or similar power source in a sleep state, and by a standard power source (such as power from a wall outlet) in the active state. For CMOS logic, the power consumed is proportional to the voltage levels being applied. Thus, a reduction in the voltage level applied in the sleep state can reduce power consumption.

An embodiment of a voltage reference generator allows adjustment of a voltage reference while consuming a constant amount of current. If a voltage bias circuit utilized with the voltage reference generator is current controlled, then each voltage output configuration for the voltage reference generator will consume the same amount of current.

An embodiment of a voltage reference generator allows for adjustment of a reference voltage without the use of a closed loop configuration, in contrast with, for example, a voltage reference that includes a differential amplifier referencing a voltage divider string. The open loop configuration utilized with the voltage reference generator can simplify system design and operation.

Figure 2:
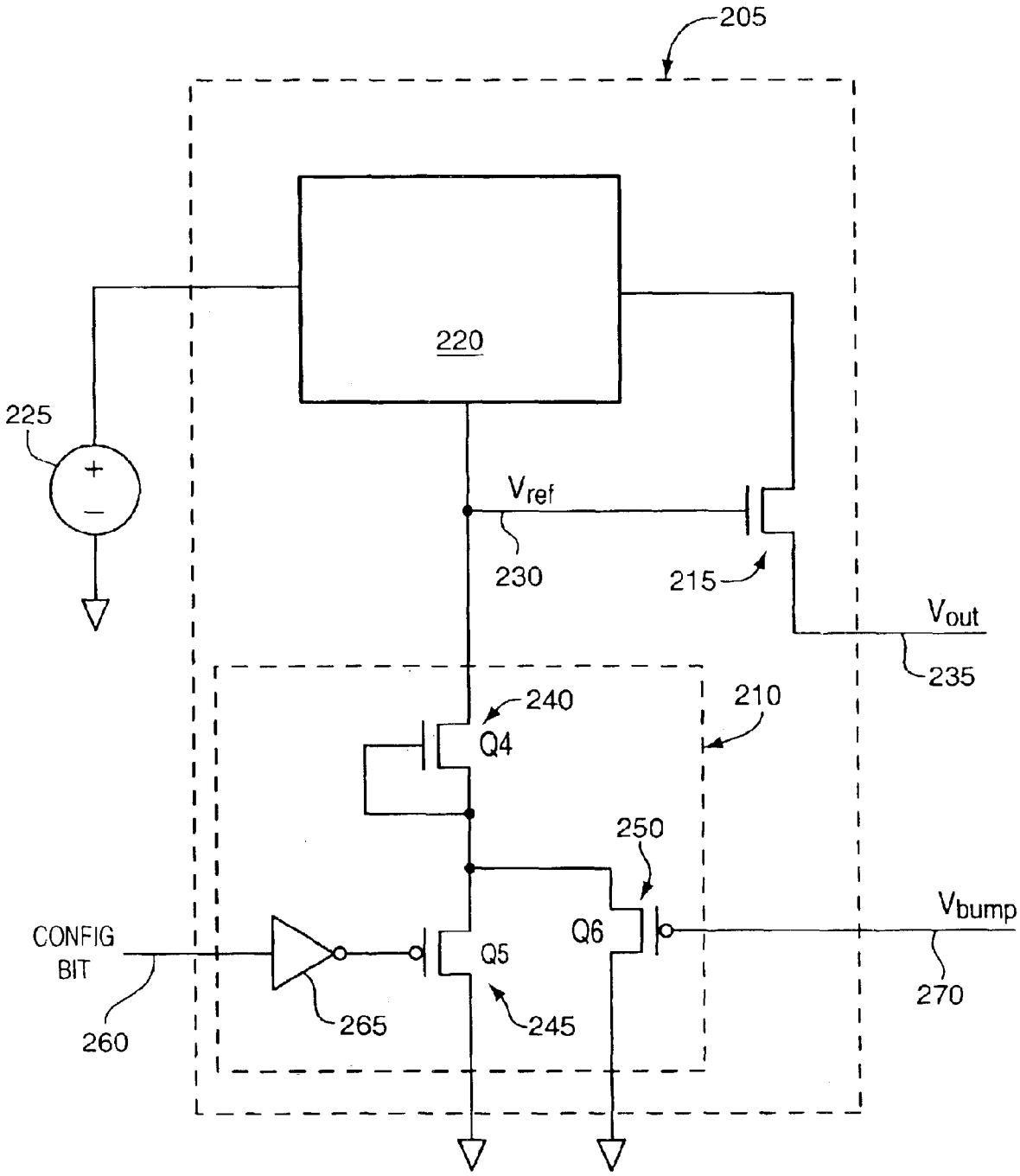
FIG. 2 is an illustration of a reference load according to an embodiment of the invention.

FIG. 2 illustrates one embodiment of a DC-to-DC converter coupled with a voltage supply. In this example, a system allows for dynamic adjustment of a $V_{out}$ supply voltage. In FIG. 2, a DC-to-DC voltage converter 205 includes a reference load 210, an output transistor device 215, and a converter circuit 220. The design of a DC-to-DC converter circuit used with an embodiment of the invention may vary, and embodiments of the invention are not limited to any particular circuit design or structure. One example of a DC-to-DC converter circuit that may utilized an embodiment of the invention is described in U.S. patent application Ser. No. 10/609,766.

The converter circuit 220 receives power from a power source 225. A voltage $V_{ref}$ 230 is produced between the reference load 210 and the converter circuit 220, which determines the output voltage $V_{out}$ 235. In FIG. 2, the output voltage $V_{out}$ 235 can be modified dynamically as needed using the reference load 210. Reference load 210 comprises a transistor device $Q_4$ 240, which is in a diode-connected configuration. The source of $Q_4$ 240 is coupled to the node producing $V_{ref}$ 230. The drain and gate of $Q_4$ 240 are coupled to the source of two transistor devices, $Q_5$ 245 and $Q_6$ 250. The gate of $Q_5$ 245 is connected to a configuration signal 260, which is utilized to adjust the value of $V_{ref}$ 230 and thereby adjust the value of $V_{out}$ 235. The gate of $Q_6$ 250 is set to a voltage $V_{bump}$ 270 to increase, or "bump", the $V_{ref}$ 230 voltage up by a certain amount. The value of $V_{bump}$ 270 map vary depending on the particular embodiment, but, in an example of a source voltage 225 in the range of 3 volts, $V_{bump}$ 270 may be set in the range of 100's of mV, such as a value in the range of 200–700 mV.

When a lower $V_{ref}$ 230 is desired, the configuration signal (Config Bit) 260 is set to "1" or $V_{CC}$ (source voltage)—an "off" signal—which allows for a low resistive path to ground to be through device $Q_5$ 245. When a higher $V_{ref}$ 230 is desired, the configuration signal 260 is set to "0" or ground—an "on" signal—creating the lowest resistive path to be through $Q_6$ 250. The voltage $V_{ref}$ 230 is the relationship $I_{Q4}$-to-$V_{gs}$ relationship for the devices $Q_4$ 240 and either $Q_5$ 245 or $Q_6$ 250 (whichever gate is lower). Because of this relationship, the $V_{ref}$ voltage can be dynamically adjusted by turning "on" and "off" the Q5 device, which forces the current path through either $Q_5$ 245 or $Q_6$ 250, respectively.

The drop across $Q_4$ 240 is the threshold voltage ($V_{tp}$) for the $Q_4$ device. When the configuration signal is "off", the path through $Q_5$ 245 results in an additional drop of the threshold voltage for $Q_5$ 245. When the configuration signal is "on", the path through $Q_6$ 250 results in a total voltage drop equal to the threshold voltage of the $Q_6$ device plus the value of $V_{bump}$ 270.

Assuming that $Q_4$ 240, $Q_5$ 245, and $Q_6$ 250 are devices with equivalent threshold voltages, the value of $V_{ref}$ 230 will be:

TABLE 1

| One-Bit Adjustment | |
|---|---|
| Configuration Signal | $V_{ref}$ |
| 1 | $2 \times V_{tp}$ |
| 0 | $V_{tp} + V_{bump}$ |

Figure 3:
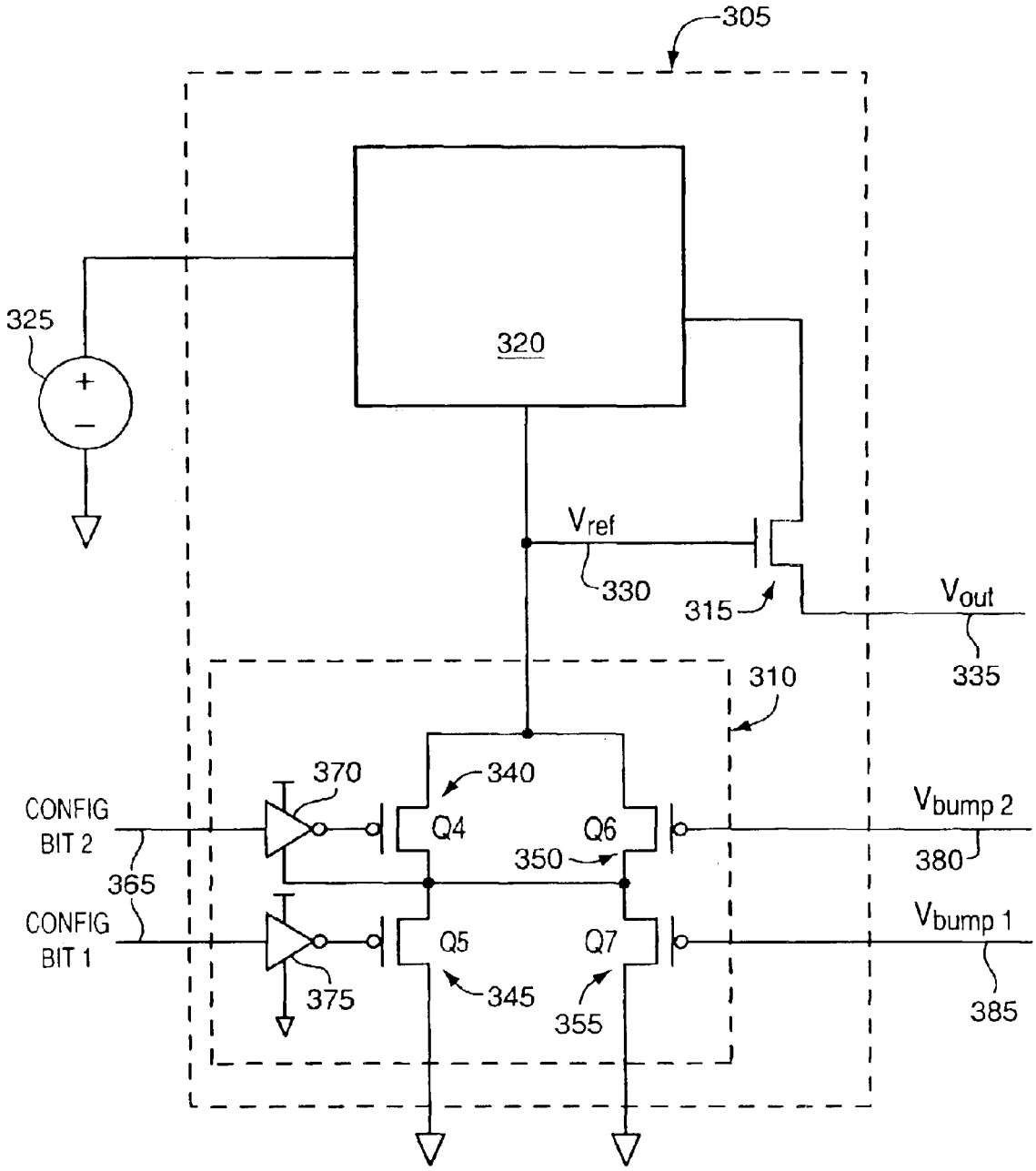
FIG. 3 is an illustration of a reference load with a cascaded structure according to an embodiment of the invention.

In one embodiment of the invention, dynamic voltage adjustment can be cascaded to increase the number of selectable voltage levels. An example of this is shown in FIG. 3. FIG. 3 illustrates a DC-to-DC converter with a voltage reference generator. The voltage reference generator provides for up to three possible reference voltage levels, but other embodiments can provide for greater numbers of voltage levels by modifying the number of devices and the configuration of such devices. In FIG. 3, a DC-to-DC voltage converter 305 includes a reference load 310, an output transistor device 315, and a converter circuit 320, which includes the remainder of the circuit. The DC-to-DC voltage converter 305 receives power from a power source 325. A voltage $V_{ref}$ 330 is produced between the reference load 310 and the converter circuit 320, which determines the output voltage $V_{out}$ 335.

In FIG. 3, the output voltage $V_{out}$ 335 can be modified dynamically as needed using the reference load 310. Reference load 310 comprises a four transistor devices, $Q_4$ 340, $Q_5$ 345, $Q_6$ 350, and $Q_7$ 355. The source terminals of $Q_4$ 340 and $Q_6$ 350 are coupled to the node producing $V_{ref}$ 330. The drain terminals of $Q_4$ 340 and $Q_6$ 350 are coupled to the source terminals of transistor devices $Q_5$ 345 and $Q_7$ 355. The drain terminals of $Q_6$ 350, and $Q_7$ 355 are coupled to ground. The gate terminals of $Q_4$ 340 and $Q_5$ 345 receive a configuration signal 365, with a first bit of the signal (Config Bit 1) being applied to $Q_5$ 345 via inverter 375 and a second bit of the signal (Config Bit 2) being applied to $Q_4$ 345 via inverter 370. Configuration signal 365 is utilized to adjust the value of $V_{ref}$ 330 and thereby adjust the value of $V_{out}$ 335. The gate of $Q_7$ 355 is set to a voltage $V_{bump1}$ 385 to increase, or "bump", the $V_{ref}$ 330 voltage by a first amount. The gate of $Q_6$ 350 is set to a voltage $V_{bump2}$ 380 to increase the $V_{ref}$ 330 voltage by a second amount. The values of $V_{bump1}$ 385 and $V_{bump2}$ 380 may vary depending on the particular embodiment, but, in an example of a source voltage 325 in the range of 3 volts, such may be set in the range of 100's of mV, such as a value in the range of 200–700 mV. In one example, $V_{bump1}$ 385 is equal to 200 mV and $V_{bump2}$ 380 is equal to 500 mV.

With the configuration as shown in FIG. 3, $V_{ref}$ can be set to three different values (if $V_{bump1}$ 385 and $V_{bump2}$ 380 are different voltage potentials). When a lower first $V_{ref}$ 330 value is desired, the configuration signal 365 may be set to "1" or $V_{CC}$ (source voltage)—an "off" signal—for both signal bits, which allows for a low resistive path to ground to be through device $Q_5$ 340 and $Q_5$ 345. When a higher second $V_{ref}$ 330 value is desired, the configuration signal 365 is set to "0" or ground—an "on" signal—for both signal bits, creating the lowest resistive path to be through $Q_6$ 350 and $Q_7$ 355. For a third $V_{ref}$ 330 voltage potential, a configuration signals of "10" may applied. The voltage $V_{ref}$ 330 is the relationship $I_{Q4}$-to-$V_{gs}$ relationship for either $Q_4$ 340 or $Q_6$ 350 and either $Q_5$ 345 or $Q_7$ 355 (whichever gate has the lower potential in each pair). The $V_{ref}$ voltage can be dynamically adjusted by effectively turning "on" and "off" the $Q_4$ 340 and $Q_5$ 345 devices, forcing the current path through different paths.

When one of the bits of the configuration signal is "off", the path through $Q_4$ 340 or $Q_5$ 345 results in a drop of the threshold voltage for the device. When one of the bits of the configuration signal is "on", the path through $Q_6$ 350 or $Q_7$ 355 results in a voltage equal to the threshold voltage of the device plus the value of either $V_{bump2}$ 385 or $V_{bump1}$ 380, respectively. Assuming that $Q_4$ 340, $Q_5$ 345, $Q_6$ 350, and $Q_7$ 355 are devices with equivalent threshold voltages, the total value of $V_{ref}$ 330 will be:

TABLE 2

Two-Bit Adjustment

| Configuration Signal | $V_{ref}$ |
|---|---|
| 11 | $2 \times V_{tp}$ |
| 01 | $V_{tp} + V_{bump1}$ |
| 10 | $V_{tp} + V_{bump2}$ |
| 00 | $V_{tp} + V_{bump2}$ |

Figure 4:
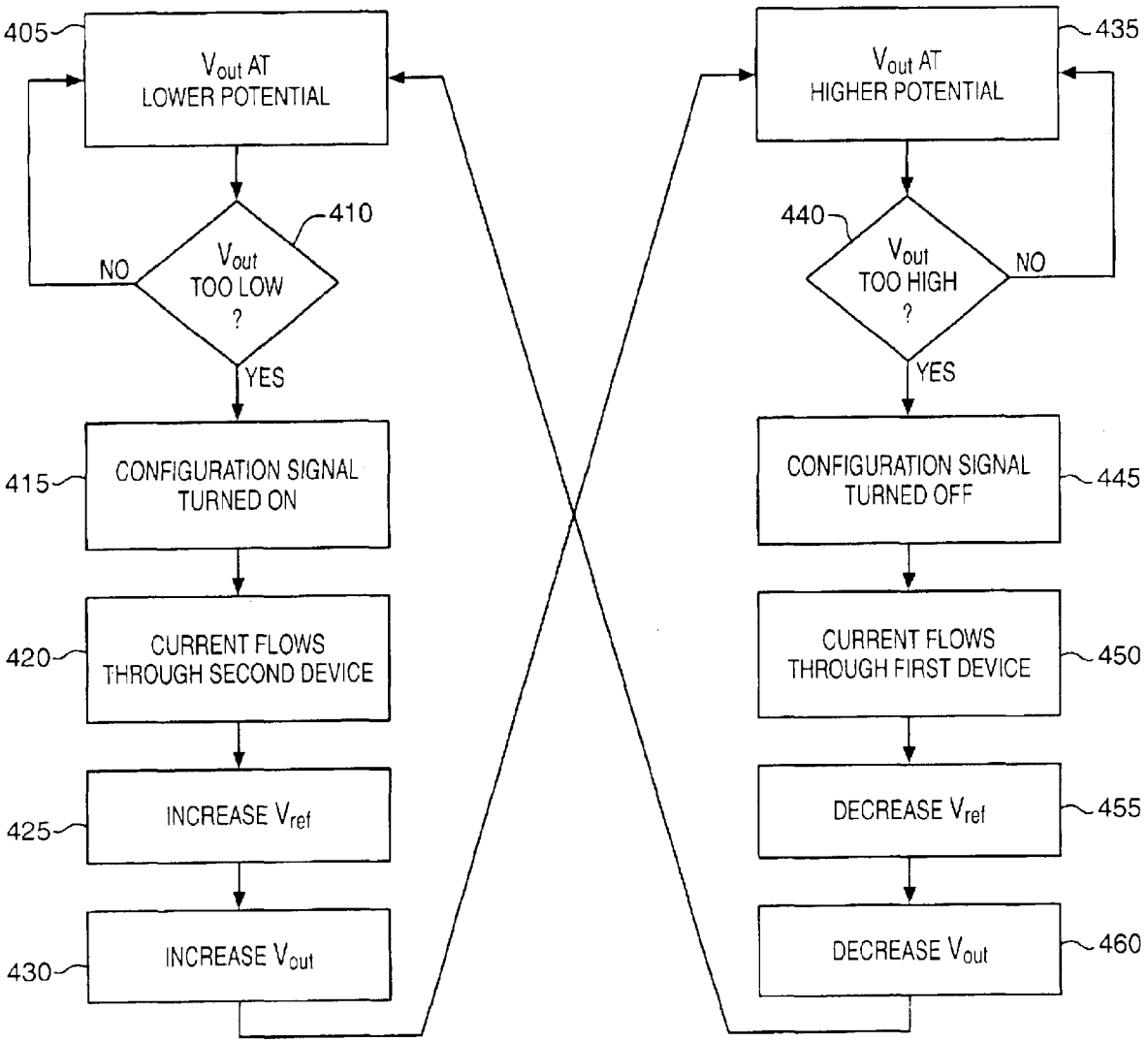
FIG. 4 is a flow chart illustrating an embodiment of a process for providing for dynamic adjustment of voltage potential.

FIG. 4 is a flowchart illustrating an embodiment a process for providing for dynamic adjustment of voltage potential. For simplicity, FIG. 4 illustrates the operation of a process in which two different voltage potentials may be chosen. Other embodiments of the invention can provide additional voltage potentials.

In this illustration, a voltage potential $V_{out}$ may initially be at either a lower potential 405 or a higher potential 435. $V_{out}$ may be a supply voltage for a circuit or device. If $V_{out}$ is at a lower potential 405, there is a determination whether $V_{out}$ is "too low", or may be increased to provide better operation of the circuit or device 410. For example, $V_{out}$ may be increased when more power is available for operation of the circuit or device. If no voltage potential change is appropriate, the voltage remains at the lower potential 405. If a change to a higher potential is appropriate, a configuration signal is turned on 415, which may mean that the signal is changed from "1" to "0". Turning on the signal results in current flowing through a second device 420 (instead of a first device that is utilized for the lower voltage potential). For example, in FIG. 2 current is directed through $Q_6$ 250 instead of $Q_5$ 245. The change in current flow causes an increase in reference voltage $V_{ref}$ 425, thereby resulting in an increase in $V_{out}$ 430. The resulting $V_{out}$ is then at a higher voltage potential 435.

If $V_{out}$ is at the higher potential 435, there is a determination whether $V_{out}$ is "too high", or may be decreased to save power or otherwise improve operation of the circuit or device 440. For example, voltage may be reduced when power levels are low. If no change in voltage potential is appropriate, the voltage remains at the higher potential 435. If a change to a lower potential is appropriate, a configuration signal is turned off 445, which may mean that the signal is changed from "0" to "1". Turning off the signal results in current flowing through the first device 450, instead of the second device. For example, in FIG. 2 current is directed through $Q_5$ 245 instead of $Q_6$ 250. The change in current flow causes a decrease in reference voltage $V_{ref}$ 455, thereby resulting in a decrease in $V_{out}$ 460. The resulting $V_{out}$ is then at the lower voltage potential 405.

Startup Circuit for DC-to-DC Converter

According to an embodiment of the invention, a reference load is utilized in conjunction with a DC-to-DC converter circuit, with the converter circuit receiving a bias voltage from a bias generator circuit. During startup conditions, a power supply, such as a 3V supply in a computer, is ramped up to the output voltage, and the output voltage is initially at ground or floating potential. While the bias generator circuit is not properly powered, the signal $V_{bias}$ also generally will be at ground or floating potential. Unless a startup circuit is applied, the currents in the converter circuit may be zero. This condition re-enforces the $V_{out}$ supply voltage being at ground potential, thus resulting in a startup failure. To overcome the initial state, sufficient power is applied to the bias generation circuit until the bias generation circuit has sufficiently started and has reached operating bias voltage levels. Once the bias generation circuit has started and voltage reaches sufficient bias levels, the startup circuit is no longer needed and can be eliminated to prevent any additional current draw. While startup circuits utilized in conjunction with an embodiment of the invention may vary and are not limited to any particular design, a startup circuit that may be utilized is a startup circuit described in U.S. patent application Ser. No. 10/331,390.

Alternative Embodiments

Figure 5:
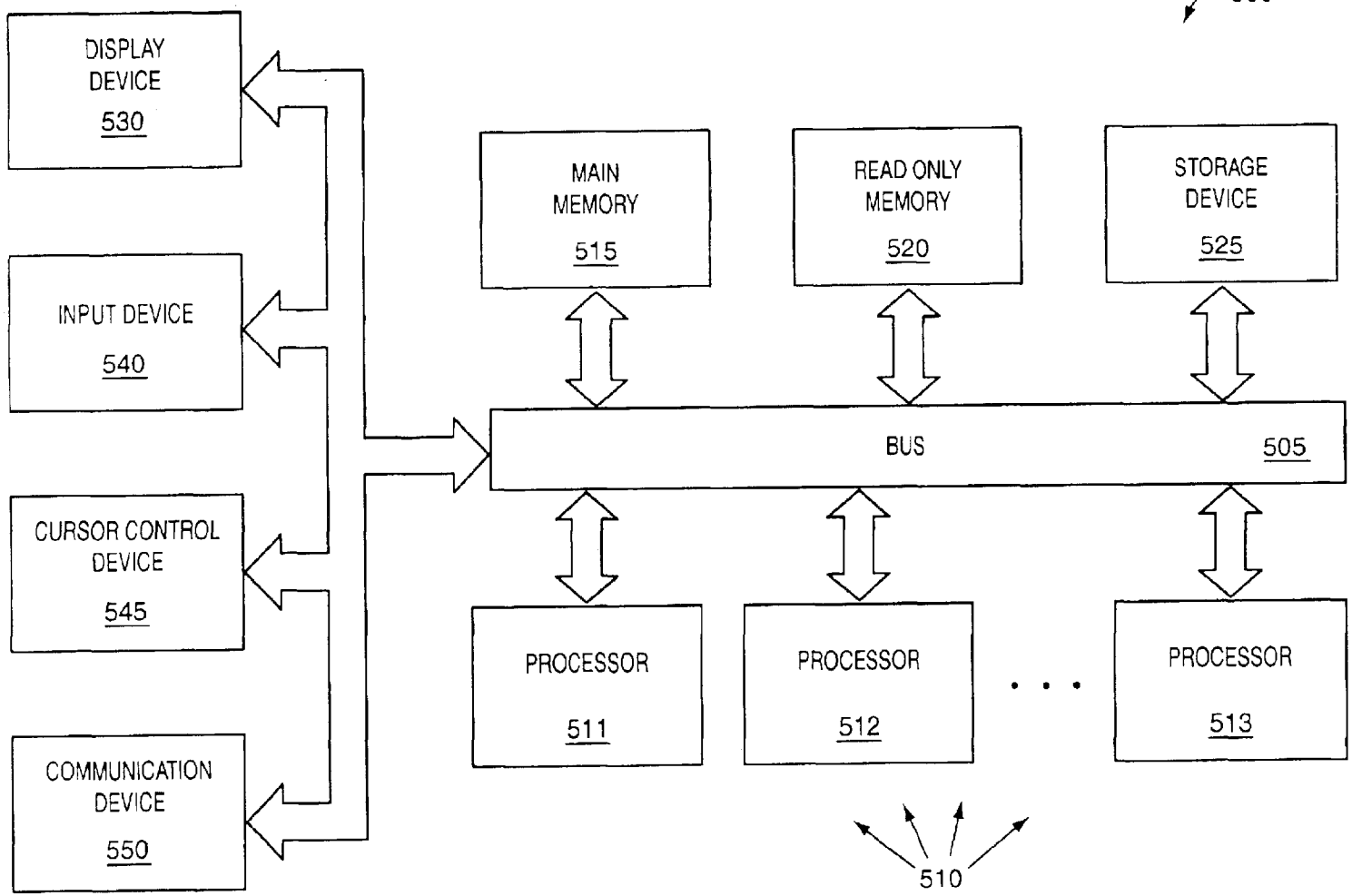
FIG. 5 is an illustration of an embodiment of a computer.

Techniques described herein may be used in many different environments. One possible environment is a computer with a backup power supply that is used to maintain the system clock. FIG. 5 is block diagram of an exemplary computer. Under an embodiment of the invention, a computer 500 contains a power source, such as a battery or capacitor, to operate a real time clock that maintains the system time for the computer when the power for the system is turned off or is otherwise unavailable. A voltage converter may convert the power from the power source to provide to the real time clock, the voltage converter utilizing a voltage from a voltage reference generator.

Under an embodiment of the invention, a computer 500 comprises a bus 505 or other communication means for communicating information, and a processing means such as one or more processors 510 (shown as 511, 512 and continuing through 513) coupled with the bus 505 for processing information. The maintained system time may be utilized by the processors 510 in normal system operations.

The computer 500 further comprises a random access memory (RAM) or other dynamic storage device as a main memory 515 for storing information and instructions to be executed by the processors 510. Main memory 515 also may be used for storing temporary variables or other intermediate information during execution of instructions by the processors 510. The computer 500 also may comprise a read only memory (ROM) 520 and/or other static storage device for storing static information and instructions for the processor 510.

A data storage device 525 may also be coupled to the bus 505 of the computer 500 for storing information and instructions. The data storage device 525 may include a magnetic disk or optical disc and its corresponding drive, flash memory or other nonvolatile memory, or other memory device. Such elements may be combined together or may be separate components, and utilize parts of other elements of the computer 500.

The computer 500 may also be coupled via the bus 505 to a display device 530, such as a liquid crystal display (LCD) or other display technology, for displaying information to an end user. In some environments, the display device may be a touch-screen that is also utilized as at least a part of an input device. In some environments, display device 530 may be or may include an auditory device, such as a speaker for providing auditory information. An input device 540 may be coupled to the bus 505 for communicating information and/or command selections to the processor 510. In various implementations, input device 540 may be a keyboard, a keypad, a touch-screen and stylus, a voice-activated system, or other input device, or combinations of such devices. Another type of user input device that may be included is a cursor control device 545, such as a mouse, a trackball, or cursor direction keys for communicating direction information and command selections to processor 510 and for controlling cursor movement on display device 530.

A communication device 550 may also be coupled to the bus 505. Depending upon the particular implementation, the communication device 550 may include a transceiver, a wireless modem, a network interface card, or other interface device. The computer 500 may be linked to a network or to other devices using the communication device 550, which may include links to the Internet, a local area network, or another environment.

General Matters

In the description above, for the purposes of explanation, numerous specific details are set forth in order to provide a thorough understanding of the present invention. It will be apparent, however, to one skilled in the art that the present invention may be practiced without some of these specific details. In other instances, well-known structures and devices are shown in block diagram form.

The present invention includes various steps. The steps of the present invention may be performed by hardware components or may be embodied in machine-executable instructions, which may be used to cause a general-purpose or special-purpose processor or logic circuits programmed with the instructions to perform the steps. Alternatively, the steps may be performed by a combination of hardware and software.

Portions of the present invention may be provided as a computer program product, which may include a machine-readable medium having stored thereon instructions, which may be used to program a computer (or other electronic devices) to perform a process according to the present invention. The machine-readable medium may include, but is not limited to, floppy diskettes, optical disks, CD-ROMs, and magneto-optical disks, ROMs, RAMs, EPROMs, EEPROMs, magnet or optical cards, flash memory, or other type of media/machine-readable medium suitable for storing electronic instructions. Moreover, the present invention may also be downloaded as a computer program product, wherein the program may be transferred from a remote computer to a requesting computer by way of data signals embodied in a carrier wave or other propagation medium via a communication link (e.g., a modem or network connection).

Many of the methods are described in their most basic form, but steps can be added to or deleted from any of the methods and information can be added or subtracted from any of the described messages without departing from the basic scope of the present invention. It will be apparent to those skilled in the art that many further modifications and adaptations can be made. The particular embodiments are not provided to limit the invention but to illustrate it. The scope of the present invention is not to be determined by the specific examples provided above but only by the claims below.

It should also be appreciated that reference throughout this specification to "one embodiment" or "an embodiment" means that a particular feature may be included in the practice of the invention. Similarly, it should be appreciated that in the foregoing description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims are hereby expressly incorporated into this description, with each claim standing on its own as a separate embodiment of this invention.

What is claimed is:

1. A reference circuit comprising:

a reference node to provide a reference voltage;

a first transistor device coupled with the reference node to receive a first configuration signal at a first gate terminal, a current to flow through the first transistor device when the first configuration signal is a first value;

a second transistor device coupled with the reference node to receive a first voltage potential at a second gate terminal, the current to flow through the second transistor device and the reference voltage to be increased by the first voltage potential when the configuration signal is a second value;

a third transistor device coupled with the first transistor device and the second transistor device, the third transistor device to receive a second configuration signal at a gate terminal, the current flowing through the third transistor device when the second configuration signal is a first value; and a fourth transistor device coupled with the first transistor device and the second transistor device, the fourth transistor device to receive a second voltage at a gate terminal, the current to flow through the fourth transistor device and the reference voltage to be increased by the second voltage when the configuration signal is a second value.

2. The reference circuit of claim 1, wherein the first voltage potential and the second voltage potential are different voltage potentials.

3. A method comprising:

receiving a supply voltage;

generating a reference voltage;

receiving a first configuration signal;

if the first configuration signal is a first value, directing a current through a first transistor device;

if the first configuration signal is a second value, directing the current through a second transistor device and increasing the reference voltage by a first voltage potential;

receiving a second configuration signal;

if the second configuration signal is a first value, directing the current through a third transistor device; and if the first configuration signal is a second value, directing the current through a fourth transistor device and increasing the reference voltage by a second voltage potential, wherein the first voltage potential and the second voltage potential are different values.

4. A microelectronic device comprising;

an output transistor; and a reference voltage generator coupled with the output transistor comprising:

a reference node to produce a reference voltage to the output transistor, and a reference load coupled with the reference node comprising:

a first transistor device to receive a first configuration signal at a gate terminal, a current to flow through the first transistor device when the first configuration signal is a first value, a second transistor device, a first terminal of the second transistor device being coupled with a first terminal of the first transistor device, the second transistor to receive a first voltage potential at a gate terminal, the current to flow through the second transistor device and the reference voltage to be increased by the first voltage potential when the configuration signal is a second value, a third transistor device coupled with a second terminal of the first transistor device and a second terminal of the second transistor device, the third transistor to receive a second configuration signal at a gate terminal, the current flowing through the third transistor device when the second configuration signal is a first value, and a fourth transistor device coupled with the second terminal of the first transistor and the second terminal of the second transistor, the fourth transistor device to receive a second voltage at a gate terminal, the current to flow through the second transistor device and the reference voltage to be increased by the second voltage when the configuration signal is a second value.

5. The microelectronic device of claim 4, wherein the first voltage potential and the second voltage potential are different voltage potentials.

6. A computer comprising:

a processor;

a clock to provide a system time for the processor;

a voltage converter to provide power for the clock; and a voltage reference generator coupled to the voltage converter, the voltage reference generator comprising:

a reference node to provide a reference voltage, a first transistor device coupled with the reference node to receive a first configuration signal at a first gate terminal, a current to flow through the first transistor device when the first configuration signal is a first value, a second transistor device coupled with the reference node to receive a first voltage potential at a second gate terminal, the current to flow through the second transistor device and the reference voltage to be increased by the first voltage potential when the configuration signal is a second value, a third transistor device coupled with the first transistor device and the second transistor device to receive a second configuration signal at a gate terminal, the current flowing through the third transistor device when the second configuration signal is a first value, and a fourth transistor device coupled with the first transistor device and the second transistor device to receive a second voltage at a gate terminal, the current to flow through the second transistor device and the reference voltage to be increased by the second voltage when the configuration signal is a second value.

* * * * *